US008739870B2

(12) United States Patent
Weirich

(10) Patent No.: US 8,739,870 B2
(45) Date of Patent: Jun. 3, 2014

(54) SYSTEM AND METHOD FOR SEALING GRAVEL EXIT PORTS IN GRAVEL PACK ASSEMBLIES

(75) Inventor: John Barton Weirich, Spring, TX (US)

(73) Assignee: Superior Energy Services, LLC, Harvey, LA (US)

( * ) Notice: Subject to any disclaimer, the term of this patent is extended or adjusted under 35 U.S.C. 154(b) by 502 days.

(21) Appl. No.: 12/329,188

(22) Filed: Dec. 5, 2008

(65) Prior Publication Data

US 2010/0139917 A1 Jun. 10, 2010

(51) Int. Cl.
*E21B 43/04* (2006.01)

(52) U.S. Cl.
USPC ..... 166/278; 166/51; 166/135; 166/227

(58) Field of Classification Search
USPC ..... 166/278, 135, 185, 192, 51, 227
See application file for complete search history.

(56) References Cited

U.S. PATENT DOCUMENTS

| | | | | |
|---|---|---|---|---|
| 4,295,524 | A | 10/1981 | Baker et al. | |
| 4,848,459 | A * | 7/1989 | Blackwell et al. | 166/142 |
| 7,032,666 | B2 | 4/2006 | Corbett | |
| 7,337,840 | B2 * | 3/2008 | Penno | 166/278 |
| 2006/0076133 | A1 * | 4/2006 | Penno | 166/278 |
| 2008/0164026 | A1 * | 7/2008 | Johnson | 166/271 |
| 2008/0314589 | A1 * | 12/2008 | Guignard et al. | 166/278 |
| 2009/0008092 | A1 * | 1/2009 | Haeberle et al. | 166/278 |

OTHER PUBLICATIONS (http://dictionary.reference.com/browse/cement).*
http://swellfix.net/products_services/gzip.php.
http://swellfix.net/products_services/bzip.php.

* cited by examiner

*Primary Examiner* — Yong-Suk (Philip) Ro
(74) *Attorney, Agent, or Firm* — Jones Walker, LLP

(57) ABSTRACT

A system having a sealing assembly for a gravel port in a gravel pack apparatus. The sealing assembly includes a sealing element around an outer circumference of the gravel pack assembly above the gravel pack and below the gravel port. The sealing element is on the outside housing of the gravel pack apparatus or on a separate piece of equipment located above the gravel pack and below the gravel port, permitting a larger flow bore through the gravel pack apparatus. The sealing element may be selectively actuated after the gravel pack operation has concluded, thus maintaining the gravel pack in the desired location. The removal of a gravel pack tool may permit the sealing element to be actuated.

17 Claims, 3 Drawing Sheets

SYSTEM AND METHOD FOR SEALING GRAVEL EXIT PORTS IN GRAVEL PACK ASSEMBLIES

BACKGROUND OF THE INVENTION

1. Field of the Invention

The present disclosure is generally directed to an improvement to sealing gravel exit ports in gravel pack assemblies, and more specifically, to a system and method for providing a seal for exits ports in gravel pack assemblies.

2. Description of the Related Art

It is common practice in the art of subterranean oil well completion to deposit gravel in an annular space between a gravel pack screen and an inner surface of a wellbore casing at a production zone to form a gravel pack, if the surrounding formation has pervasive sand and/or other particulates. Due to its abrasive nature, formation sand in the production fluid is detrimental to downhole completion equipment and surface production equipment. The gravel pack may be used to filter out the particulates. Gravel packing comprises packing with gravel the annulus between the perforated casing or openhole wellbore and slotted screens, a gravel pack screen, positioned opposite the perforations or desired formation, proximate to a production tubing opening, to form a filter for reducing the flow of formation sand into the wellbore.

In conventional methods of gravel packing, a gravel pack slurry is displaced down the tubing string and through the gravel pack assembly to deposit the gravel in wellbore perforations or openhole annulus and in an annular space between the casing or wellbore and the gravel pack screen attached to the gravel pack assembly. The gravel slurry exits the gravel pack assembly into the annulus through at least one gravel exit port. Typically, such gravel exit ports comprise a hole through a portion of the gravel pack assembly housing. The hole of a gravel pack exit port is typically larger than the size of the aggregate gravel to allow free flow there through while the gravel packing procedure is carried out. After depositing the gravel pack, the gravel ports are closed and sealed with a gravel exit port seal so that other wellbore completion operations may be carried out. Typically, a gravel exit port seal comprises a sleeve with at least two sealing elements, such as o-rings. The exit port seal sleeve is typically located in an internal bore of the gravel pack assembly housing on an internal surface of the housing and may vertically slide within the bore. While gravel slurry is passing through the gravel port and being deposited in the wellbore, the gravel pack seal sleeve remains adjacent to the gravel port in an "open" position permitting flow through the gravel port. The exit port seal closes by the sleeve sliding over the exit port, thus covering it, positioning sealing elements above and below the exit port. Other port systems may use a rotating sleeve or have an external sliding mechanism or some other external sealing means.

The prior art gravel exit port seal described above may potentially fail due to repeated use, the abrasive nature of the gravel slurry, or other conditions in the wellbore. Further, there exits the potential that the sleeve may not function properly failing to move to the "closed" position at the completion of the gravel packing procedure or inadvertently being moved to the open position during other wellbore completion operations permitting communication between the bore of the gravel pack assembly and the annulus containing the gravel pack. Thus, it is a common practice to employ a secondary gravel exit port seal mechanism. Such secondary seals are known in the prior art as "straddle seals" because they form a seal against the inner surface of the gravel pack assembly housing above and below the gravel exit ports. The straddle seal comprises a housing having a plurality of sealing elements, such as o-rings or molded seals, around its outer circumference. The straddle seal is positioned within the gravel pack assembly bore such that the plurality of sealing elements mate and seal with a seal bore on the inner surface of the gravel pack housing assembly located above the gravel exit port and a seal bore on the inner surface of the gravel pack housing assembly located below the gravel exit port. The sealing elements prevent the flow of gravel out of the annulus into the production bore in the event that the gravel exit port seal fails or is not properly located in the closed position.

The secondary seal housing further includes an inner bore permitting the production of hydrocarbons from the well formation. Because the straddle seal occupies space inside the gravel pack assembly bore, the effective internal cross-sectional area of the gravel pack assembly is reduced, which may detrimentally affect hydrocarbon production efficiency or other wellbore completion operations. The secondary seal assembly is set after the gravel pack has been deposited within the well bore. To set the secondary seal, a setting tool must be run down the work string. This additional trip down the work string requires additional rig costs and may take up a large amount of time, thereby prohibiting production during this time and increasing the operating costs of the well completion.

Thus, what is needed is a secondary or novel primary sealing mechanism that reliably seals the gravel pack assembly gravel exit port without constricting the inner cross-sectional area of the gravel pack assembly and without requiring an additional trip down the well to set.

The present disclosure is directed to an apparatus and method for solving, or at least reducing the effects of, some or all of the aforementioned problems.

SUMMARY OF THE DISCLOSURE

The following presents a summary of the disclosure in order to provide a basic understanding of some aspects disclosed herein. This summary is not an exhaustive overview, and it is not intended to identify key or critical elements of the invention or to delineate the scope of the invention as set forth in the appended claims.

One illustrative embodiment of the present disclosure is a system for isolating a gravel pack that includes a longitudinal screen, a gravel pack housing, and a sealing device. The longitudinal screen has an exterior surface and an interior bore. The screen is adapted to permit the flow of fluid, such as hydrocarbons from the formation, from the exterior surface of the screen into the interior bore of the screen. The screen is also adapted to retain a gravel pack in an annulus between a wellbore casing and the exterior surface of the screen. The gravel pack may act as a filter to prevent the flow of particles with the fluid into the interior bore of the screen. The gravel pack housing has an exterior surface and an interior bore in communication with the interior bore of the screen. The housing connects the screen to a packer that is set against the casing hydraulically isolating the annulus between housing and the wellbore casing. The housing has at least one fluid port permitting fluid communication between the interior bore and the annulus between the casing and the screen. The fluid port permits the flow of gravel slurry into the annulus to form a gravel pack.

The sealing device of the system is positioned on the exterior of the housing and will be located within the annulus between the housing and the wellbore casing when the system is positioned within the wellbore. The sealing device is adapted to selectively provide a seal between the housing and the casing. The sealing device is positioned below the fluid port and above the screen and when actuated prevents the flow of gravel from the gravel pack to the fluid port of the housing.

The system may include a sleeve that is movably connected to the housing. The sleeve may be moved between an open position and a closed position. In the open position, gravel slurry may flow through the at least one fluid port to form a gravel pack in the annulus. In the closed position, the sleeve prevents fluid flow into the annulus. The sealing device may be hydrostatically, hydraulically, or mechanically actuated to provide the seal in the annulus. Alternatively, the sealing device may be an inflatable packing device or may be a swellable device. The sealing device may comprise an oil or water swelling elastomer. The sealing device of the system may be positioned above the gravel pack in the annulus.

Another illustrative is a method of isolating a gravel pack port in a gravel pack assembly. The method includes preventing fluid flow through a port of the gravel pack assembly and actuating a sealing element positioned within an annulus between the gravel pack assembly and a wellbore casing. The port permits fluid communication between a central bore of the gravel pack assembly and the annulus. The sealing element is positioned below the port on the gravel pack assembly and above the gravel pack within the annulus. The sealing element may prevent the flow of gravel from the gravel pack in the annulus to the port of the gravel pack assembly. The actuated sealing element may fully extend between the gravel pack assembly and the wellbore casing. The method may further include producing hydrocarbons from a formation through the gravel pack assembly. The method may also include removing a gravel pack tool, the removal of the gravel pack tool shifting a sleeve that permits the actuation of the sealing element.

Another embodiment is a sealing assembly for a gravel pack assembly that includes a sealing element positioned on an outer diameter of a gravel pack housing that has an inner bore. The housing is connected to a gravel pack screen and includes a gravel port that selectively permits fluid flow to an annulus between a casing and the housing. The sealing element is positioned below the gravel port of the housing. The sealing element is also positioned above the gravel pack screen. When the gravel pack assembly is positioned within the wellbore, the sealing element will be positioned within the annulus between the casing and the gravel pack housing. The sealing element may be actuated to prevent the flow of gravel between the gravel pack and the gravel port. The removal of a gravel pack tool may permit the actuation of the sealing element.

BRIEF DESCRIPTION OF THE DRAWINGS

This disclosure may be understood by reference to the following description taken in conjunction with the accompanying drawings, in which like reference numerals identify like elements, and in which.

Figure 1:
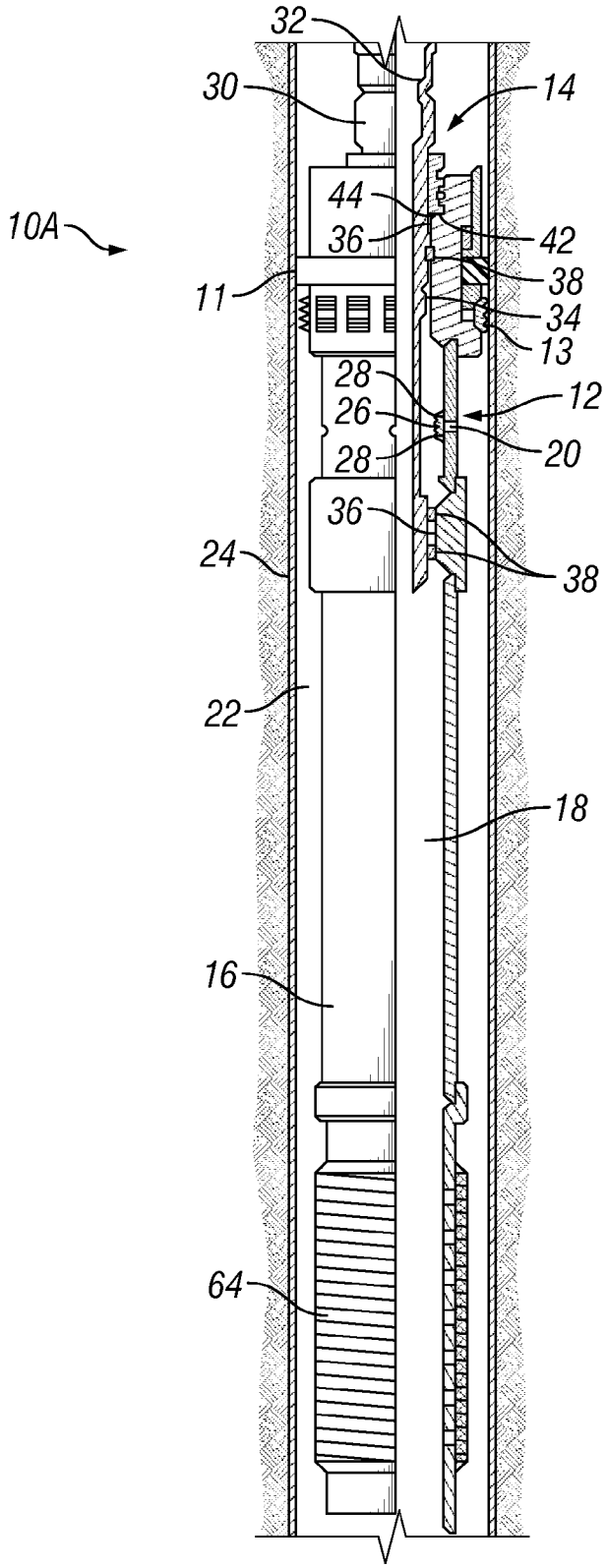
FIG. 1 (Prior Art)
FIG. 1 depicts a partial cross-section view of a prior art gravel pack assembly.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the disclosure as defined by the appended claims.

DETAILED DESCRIPTION

Illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

FIG. 1 depicts a prior art embodiment of a gravel pack assembly 10A with a primary gravel exit port seal 12 and an internal secondary gravel exit port seal assembly 14. The gravel pack assembly 10A may be secured in place by a slip or anchor device 13. The gravel pack assembly 10A comprises a housing 16 having a central bore 18 and a plurality of gravel exit ports 20 (only one shown in FIG. 1) providing fluid communication between the bore 18 and an annulus 22 between the outer surface of the housing 16 and an inner surface of a wellbore casing 24. A gravel placement tool (not shown) positioned within the assembly 10A allows a gravel slurry to flow from the central bore through the gravel exit port 20 into the annulus to form a gravel pack 66 (shown in FIG. 2) in the annulus 22 between a screen 64 (shown in FIG. 2), connected to the housing 16, and the casing 24. An upper packer 11 provides an upper boundary of the annulus 22 and a lower packer, bull plug, or other means (not shown) provides a lower boundary of the annulus 22.

The primary seal 12 comprises a sliding sleeve 26 with two sealing elements 28, which may be elastomeric o-rings, contacting an internal surface of the housing 16. The 26 sleeve may be vertically slid within the bore 18 with a gravel pack tool (not shown) to selectively cover or uncover the gravel exit port 20. This prior art primary gravel exit port seal 12 may not be dependable due to elevated pressures and other conditions in the wellbore. Further, the movement of the sleeve 26 between the open and closed positions moves at least one of the sealing elements 28 across the opening of the exit port 20, which may increases the likelihood that the sealing element 28 may fail.

Because the primary gravel exit port seal 12 may be undependable, it is common in industry to use an internal secondary seal assembly 14 to prevent gravel or other particles from flowing out of the annulus 22 into the production bore 18 through the gravel exit port 20. As shown in FIG. 1, the internal secondary seal assembly 14 comprises a cylindrical housing 30 that has a central bore 32 providing communication above and below the secondary seal assembly 14. The secondary seal assembly housing 30 has an outer profile 34 that corresponds to seal bores 36 on the interior surface of the gravel pack assembly 10A above and below the gravel exit port 20. Sealing elements 38 positioned near the top and bottom portions of the housing 30 provide a seal when engaged with internal seal bores 36 of the gravel pack assembly 10A. After the gravel packing procedure is completed, the secondary seal assembly 14 may be lowered on a work string (not shown) into the gravel pack assembly bore 18 until a downward-facing secondary seal shoulder 42 engages an upward-facing shoulder 44 of the gravel pack assembly 10A positioning the secondary seal 14 is in a "closed" position. In the closed position, the secondary sealing elements 38 seal against seal bores 36 of the gravel pack assembly 10A creating a secondary seal that prevents fluid flow through the gravel exits port 20. In this closed position, the secondary sealing elements 38 are located both above and below the gravel exit port 20, straddling the gravel exit port 20 and hydraulically isolating the port 20 from the gravel pack assembly central bore 18. While the secondary seal assembly 14 is in its closed position, its central bore 32 provides communication between the gravel pack assembly central bore 18 and the wellbore above the secondary seal assembly 14, which allows further completion operations and wellbore production to be accomplished.

As discussed above, the addition of a prior art secondary seal apparatus 14 reduces the cross-sectional flow area of the gravel pack assembly 10A which may reduce the production flow from the formation. Another disadvantage of the secondary gravel exit port seal assembly 14 is that it requires an additional trip down the well bore to place the seal assembly 14, thus delaying production and increasing operating expenses.

Figure 2:
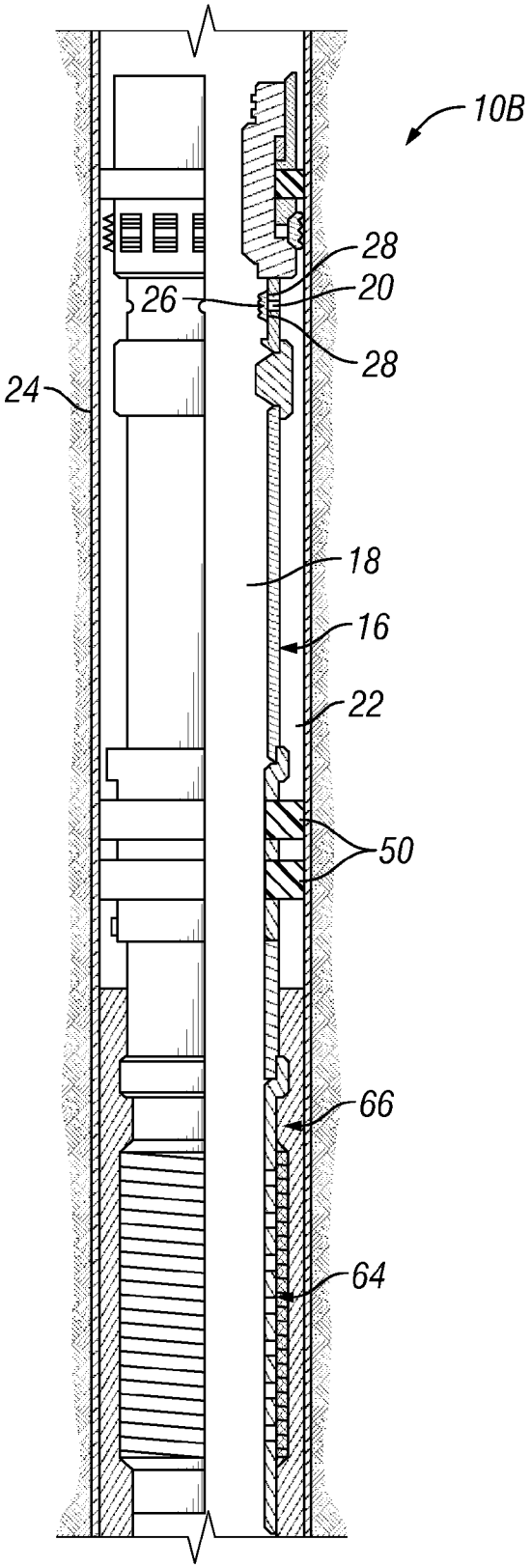
FIG. 2 depicts a partial cross-section view of an embodiment of a gravel pack system having an exterior gravel port sealing element.

FIG. 2 depicts a sealing assembly 50 of the present disclosure located on the exterior of a gravel pack assembly housing 16. As described above, gravel slurry is deposited in the annular space 22 between the outer surface of the gravel pack assembly 10B and the inner surface of the wellbore casing 24. The gravel slurry passes from the central bore 18 of the gravel pack assembly 10B to the annular space 22 through at least one gravel exit port 20 through the gravel pack assembly housing 16. A screen 64 at the lower end of the gravel pack assembly 10B prevents gravel from reentering the production bore 18 while permitting fluids to pass through to the production bore 18. A gravel pack 66 is formed as the gravel from the slurry is left in the annular space 22 while the slurry liquid recirculates. The gravel pack 66 may then act as a filter permitting fluid produced from the formation to pass through to the production bore 18 while preventing the passage of particles, such as sand, to be carried with the fluid into the production bore 18.

As shown in FIG. 2, the gravel pack assembly 10B has a housing 16 with a sealing element 50 located around its outer circumference below the gravel exit port(s) 20 and above the gravel pack 66 and/or screen 64. This sealing element 50 may be located on an additional device, such as a packer, installed between the housing 16 and screen 64. The external sealing element 50 may selectively be actuated or deactivated by vertically sliding an actuating sleeve (not shown) or by other actuation methods in the art. The actuating sleeve may be actuated or shifted by a profile on a gravel pack tool (not shown) on a work string. After the gravel pack procedure is completed, the work string and the gravel pack tool may be lifted out of the production bore 18, thereby actuating the sleeve, which in turns actuates or permits the actuation of the external sealing element 50. The embodiment depicted in FIG. 2 includes an internal sliding sleeve gravel exit port seal 26, as described above. The gravel exit port seal element 26 includes multiple sealing elements 28, and is actuated in a manner described above. The sealing element 50 may act as a secondary sealing means in addition to the gravel exit port seal element 26. Alternatively, the external sealing element 50 may be the primary means of hydraulically isolating the gravel exit port(s) 20 from the gravel pack 66.

In one embodiment, the vertical movement of the actuating sleeve exposes a chamber to the gravel pack assembly central bore 18. The sealing element may be an inflatable type sealing element, which relies on pressure in the chamber to expand. An increase in pressure in the bore increases chamber pressure, causing the exterior sealing element 50 to radially expand outward, making contact and sealing with the inner surface of the wellbore casing 24. The exterior sealing element 50 seals off the annulus 22 above the gravel pack 66 and screen 64 from the annulus 22 below, thus preventing the gravel pack 66 from moving upward and out of the gravel exit port(s) 20 into the production bore 18, in the instance of an open or failed seal sleeve 26. In this manner, the exterior sealing element 50 maintains the gravel pack 66 in place during further wellbore completion and production.

Before the actuating sleeve has been moved, the exterior sealing element 50 will not expand because the actuating sleeve prevents fluid communication between the gravel pack assembly central bore 18 and the actuation chamber. In this manner, the exterior sealing element 50 will not expand before the work string and gravel pack tool are lifted upward, preventing undesired premature sealing element activation. In another embodiment, the exterior sealing element comprises a mechanically expanding sealing element that may be mechanically actuated by moving the actuating sleeve.

In another embodiment, the exterior sealing element comprises a swellable elastomer around the exterior of a gravel pack assembly housing. Swellable elastomers are known in the art and may generally be defined as an elastomer that increases in volume when subjected to certain conditions. For example, a swellable elastomer may be a water-activated swellable elastomer, which only swells when exposed to water. A swellable elastomer may likewise be oil-activated. A swellable elastomer may be manufactured to selectively exhibit certain desirable swelling properties, such as expansion rate or activation type, by altering its composition. Upon reaching a predetermined volume, the swelling elastomer will generally maintain that volume for a number of years. Thus, an exterior sealing element may comprise a water-activated swellable elastomer with a known expansion rate. A swellable elastomer exterior sealing element on a gravel pack apparatus may be activated before the apparatus is inserted into a wellbore. Because the expansion rate of the swellable elastomer may be predetermined, the gravel packing operation may be accomplished before the exterior sealing element has completely expanded. Alternatively, activation of the swellable elastomer may take place after the gravel pack operation has completed by remotely introducing the activation compound, namely water or oil, to the swellable elastomer in the wellbore.

In another embodiment, the exterior sealing element is a unidirectional sealing element that is capable of sealing in the upward direction but not in the downward direction. The unidirectional sealing element may protrude from the exterior surface of the gravel pack housing, thereby making constant contact with the casing inner surface while the gravel pack apparatus is within the wellbore. As the gravel slurry is pumped into the annulus, the slurry may flow freely over the seal in the downward direction. The unidirectional seal may subsequently prevent gravel from moving in the upward direction, thus maintaining the gravel pack in place during ensuing well completion and/or production procedures.

Figure 3:
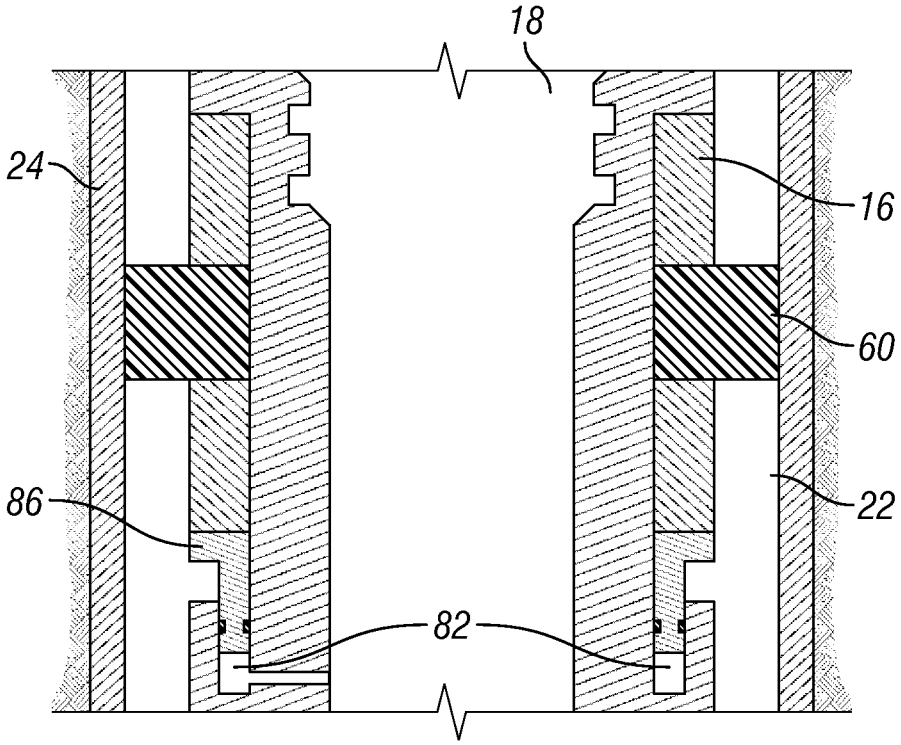
FIG. 3 depicts a cross-section view of one embodiment of an actuating mechanism for actuating the exterior sealing element of a gravel pack system.

FIG. 3 shows a detailed view of one embodiment the actuation of an external sealing element 60 that is a deformable external sealing element. The actuation mechanism may include a chamber 82 in fluid communication with a gravel pack assembly central bore 18. The fluid pressure within the bore 18 is increased after completion of the gravel pack procedure, thereby increasing the fluid pressure within the chamber 82. The increased pressure forces a sleeve 86 to move upward relative to the external sealing element 60. The sleeve 86 moves upward and applies a deforming force to a deformable external sealing element 60. As the pressure in the chamber increases, the upward force imparted to the sleeve 86 increases. As the sleeve 86 continues to push upward against the sealing element 60, the sealing element 60 deforms radially outward until it engages the wellbore casing 24.

FIG. 3 illustrates the deformable external sealing element 60 engaged with the casing 24. While the chamber 82 does not have an elevated fluid pressure, the sealing element 60 is not expanded, but an outer surface thereof is essentially flush with the gravel pack assembly housing 16. As discussed above, the deformable external sealing element 60 is located above the gravel pack 66 and below gravel exit port(s) 20 (shown in FIG. 2) on the gravel pack assembly housing 16. Upon expansion, the sealing element 60 isolates the annular space 22 located below the exterior sealing element 60 from the gravel exit port 20 of the gravel pack housing 16. An alternate embodiment may further comprise a locking mechanism to lock the sleeve 86 in its upper position, thus maintaining the sealing element 60 engagement with the wellbore casing 24 even upon a decrease in fluid pressure in the chamber 82. Another alternate embodiment may include an inner sleeve that prevents fluid communication between the chamber 82 and the gravel pack assembly central bore 18 until actuated by lifting a gravel pack tool upward, thereby preventing the external sealing element 60 from activating prematurely.

The mechanisms for actuating the exterior sealing element described herein have been provided for illustrative purposes only and are not intended to represent an exhaustive listing or otherwise limit the scope of this disclosure. One of ordinary skill in the art having the benefit of this disclosure may envision various alternative actuation mechanisms, all of which fall within the scope of this disclosure. Such actuation mechanisms may presently be in use in the industry for actuating sealing or packer elements for various types of wellbore assemblies, or may not yet be conceived. Modification of these alternative actuation mechanisms, configured according to the present disclosure, falls within the scope of the disclosure.

The particular embodiments disclosed above are illustrative only, as the disclosure may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the disclosure. Accordingly, the protection sought herein is as set forth in the claims below.

What is claimed:

1. A system for isolating a gravel pack, the system comprising:

a longitudinal screen having an exterior surface and an interior bore, the screen being adapted to permit fluid to pass from the exterior surface into the interior bore and to retain the gravel pack in an annulus between a wellbore and the exterior surface of the screen;

a housing having an exterior surface and an interior bore in communication with the interior bore of the screen, the housing connecting the screen to a packer that is adapted to be set against a casing, the housing having at least one fluid port permitting a fluid communication between the interior bore and the annulus between the casing and the screen; and a sealing device positioned directly on the exterior surface of the housing, the sealing device being adapted to selectively provide a seal between the housing and the casing, the sealing device being positioned below the fluid port and above the screen most proximate to the fluid port, and the sealing device being actuated after the gravel pack is formed.

2. The system of claim 1, further comprising a sleeve movably connected to the housing that is movable between an open position and a closed position, wherein in the open position a gravel slurry flows through the at least one fluid port and in the closed position the sleeve prevents fluid flow through the at least one fluid port.

3. The system of claim 1, wherein the sealing device may be hydrostatically, hydraulically, or mechanically actuated to provide the seal.

4. The system of claim 1, wherein the sealing device is an inflatable packing device.

5. The system of claim 1, wherein the sealing device is a swellable device.

6. The system of claim 5, wherein the sealing device comprises an oil or water swelling elastomer.

7. The system of claim 1, wherein the sealing device is positioned above the gravel pack in the annulus.

8. The system of claim 1, wherein the system forms a gravel pack assembly and the sealing device prevents flow of gravel from the gravel pack in the annulus to the port of the gravel pack assembly.

9. The system of claim 1, further comprising a gravel placement tool, wherein removal of the gravel placement tool shifts a sleeve permitting the actuation of the sealing device.

10. A system for isolating a gravel pack, the system comprising:

a longitudinal screen having an exterior surface and an interior bore, the screen being adapted to permit fluid to pass from the exterior surface into the interior bore and to retain the gravel pack in an annulus between a wellbore and the exterior surface of the screen;

a housing having an exterior surface and an interior bore in communication with the interior bore of the screen, the housing connecting the screen to a packer that is adapted to be set against a casing, the housing having at least one fluid port permitting a fluid communication between the interior bore and the annulus between the casing and the screen; and a sealing device positioned directly on the exterior surface of the housing, the sealing device being adapted to selectively provide a seal between the housing and the casing, the sealing device being positioned above the screen and below the fluid port most proximate to the screen, the sealing device being actuated after the gravel pack is formed; and wherein the sealing device is an unidirectional sealing device that allows a gravel slurry to pass in a downward direction and prevents the gravel slurry from passing in an upward direction.

11. A system for isolating a gravel pack, the system comprising:

a longitudinal screen having an exterior surface and an interior bore, the screen being adapted to permit fluid to pass from the exterior surface into the interior bore and to retain the gravel pack in an annulus between a wellbore and the exterior surface of the screen;

a housing having an exterior surface and an interior bore in communication with the interior bore of the screen, the housing connecting the screen to a packer that is adapted to be set against a casing, the housing having at least one fluid port permitting a fluid communication between the interior bore and the annulus between the casing and the screen;

a sealing device positioned on the exterior surface of the housing, the sealing device being adapted to selectively provide a seal between the housing and the casing, the sealing device being positioned below the fluid port and above the screen most proximate to the fluid port, and the sealing device being actuated after the gravel pack is formed; and wherein the sealing device is positioned above the gravel pack in the annulus.

12. The system of claim 11, further comprising a sleeve movably connected to the housing that is movable between an open position and a closed position, wherein in the open position a gravel slurry may flow through the at least one fluid port and in the closed position the sleeve prevents fluid flow through the at least one fluid port.

13. The system of claim 11, wherein the sealing device may be hydrostatically, hydraulically, or mechanically actuated to provide the seal.

14. The system of claim 11, wherein the sealing device is an inflatable packing device.

15. The system of claim 11, wherein the sealing device is a swellable device.

16. The system of claim 11, wherein the system forms a gravel pack assembly and the sealing device prevents flow of gravel from the gravel pack in the annulus to the port of the gravel pack assembly.

17. The system of claim 11, further comprising a gravel placement tool, wherein removal of the gravel placement tool shifts a sleeve permitting the actuation of the sealing element.

* * * * *